US005111833A

United States Patent [19]

Leu

[11] Patent Number: 5,111,833

[45] Date of Patent: May 12, 1992

[54] STRUCTURE OF ASHTRAY

[76] Inventor: Juan-Bao Leu, No. 128, Nanchin Wu Str., Feng Shan City, Kaohsiung Hsien, Taiwan

[21] Appl. No.: 734,610

[22] Filed: Jul. 23, 1991

[51] Int. Cl.[5] ..... A24F 19/10

[52] U.S. Cl. ..... 131/231; 131/241

[58] Field of Search ..... 131/231, 240.1, 241

[56] References Cited

U.S. PATENT DOCUMENTS 4,428,386 1/1984 Alloway ..... 131/231
4,671,300 6/1987 Grube et al. ..... 131/231
4,881,554 11/1989 Obasogie ..... 131/231 X
4,953,571 9/1990 Tremblay ..... 131/231
4,996,995 3/1991 Kojima ..... 131/231 X

*Primary Examiner*—V. Millin
*Assistant Examiner*—J. Doyle
*Attorney, Agent, or Firm*—Bacon & Thomas

[57] ABSTRACT

An having comprising a top ring supported above a base container by three ornamental posts, wherein the base container has a ring-shaped, tapered top edge at the top in outer diameter larger than the top ring for guiding cigarette butt from the top ring into the chamber inside the base container.

1 Claim, 2 Drawing Sheets

STRUCTURE OF ASHTRAY

BACKGROUND OF THE INVENTION

The present invention relates to ashtrays and relates more particularly to an ashtray rich in ornament which has a ring-shaped, tapered top edge on the base container thereof at the top for guiding cigarette butt which drops from a top ring, which is supported above said ring-shaped, tapered top edge for placing burning cigarette, into the chamber inside said base container.

In any smoking area inside a building, ashtrays must be provided for collecting tobacco ashes and cigarette butts. A regular ashtray is generally comprised of a container having grooves on the topmost edge thereof for holding burning cigarettes (see FIG. 1). If a burning cigarette is placed on any groove on the topmost edge of an ashtray, the cigarette butt may fall from the ashtray to the table surface, on which the ashtray is placed, once the cigarette is burned out. Therefore, one must be very careful in placing a burning cigarette on either groove on the topmost edge of an ashtray. In case of carelessness, a burning cigarette may fall from an ashtray to the surface which supports said ashtray, causing said surface to be damaged or even causing a fire accident.

SUMMARY OF THE INVENTION

The present invention has been accomplished to eliminate the aforesaid problems. According to one aspect of the present invention, there is provided an ashtray which is generally comprised of a top ring supported by posts above a base container, wherein said top ring has grooves on the topmost edge thereon equiangularly spaced from one another and disposed in radial direction for placing burning cigarette; said base container has a ring-shaped, tapered top edge for guiding cigarette butt, which falls from said top ring, into the chamber therein.

According to another aspect of the present invention, the posts which support the top ring above the base container are respectively made in any of a variety of ornamental shapes to make the whole assembly more attractive.

According to still another aspect of the present invention, the top ring which has pins at the bottom respectively fastened in the posts at the top of the base container can be conveniently detached from the base container for cleaning purpose.

DETAILED DESCRIPTION OF THE PREFERRED EMBODIMENT

Figure 3:
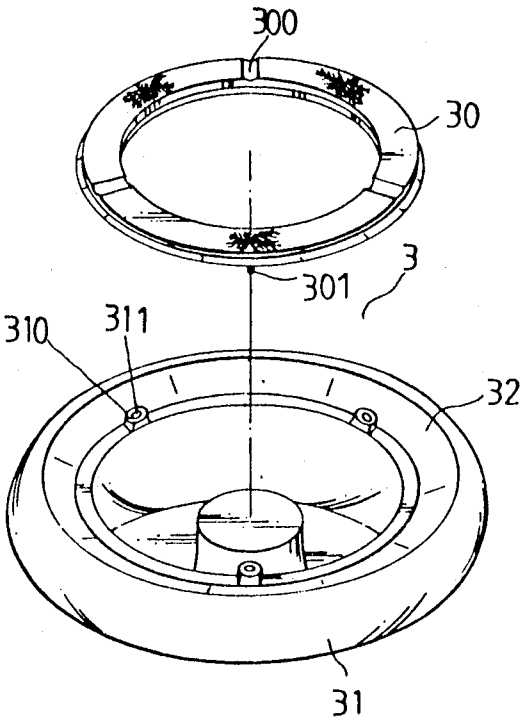
FIG. 3 is an exploded perspective view of the preferred embodiment of the ashtray of the present invention.
Figure 2:
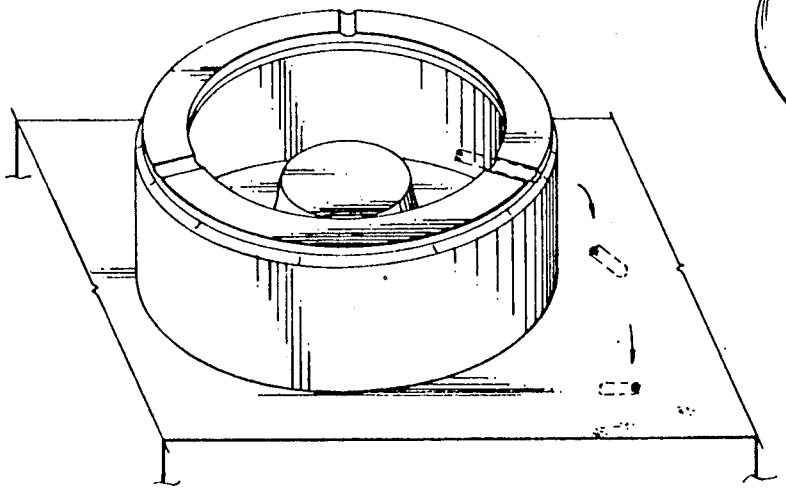
FIG.2 PRIOR ART
FIG. 2 illustrates that a cigarette butt which is placed on either groove on the topmost edge of the ashtray of FIG. 1 tends to fall to the outside.
Figure 1:
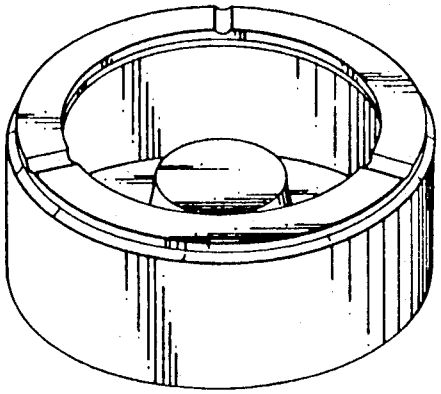
FIG.1 PRIOR ART
FIG. 1 illustrates an ashtray according to the prior art.
Figure 6:
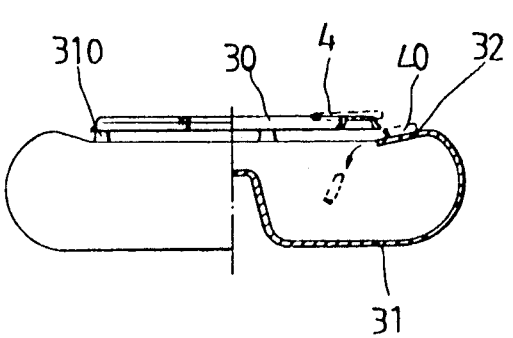
FIG. 6 illustrates the use of the present invention showing that a cigarette butt which falls from the top ring is guided by the ring-shaped, tapered top edge of the base container to drop into the chamber therein.
Figure 5:
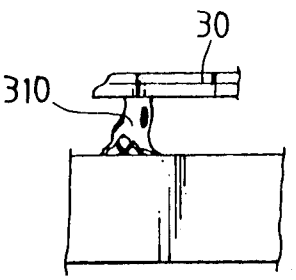
FIG. 5 is a partly enlarged view of the ashtray of the present invention showing that each post is made in an ornamental shape like a tree.
Figure 4:
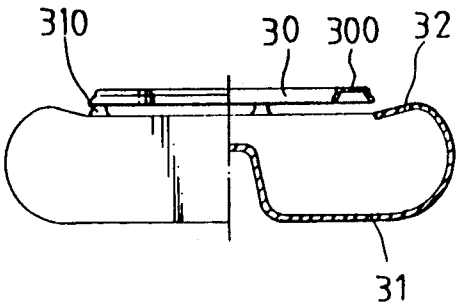
FIG. 4 is a partly sectional view of the ashtray of the present invention.

Referring to FIGS. 3 and 4, therein illustrated is the preferred embodiment of the ashtray 3 of the present invention which is generally comprised of a base container 31 and a top ring 30. The base container 31 which defines therein a chamber for collecting tobacco ashes has a ring-shaped, tapered top edge 32 and three posts 310 vertically equiangularly raising from said ring-shaped, tapered top edge 32 each of which has a hole 311 on the topmost edge thereof. Each post 310 may be shaped like a tree or a doll or made in any of a variety of shapes (see FIG. 5). The top ring 30 which has an outer diameter smaller than the outer diameter of the ring-shaped, tapered top edge 32 of the base container 31 comprises three pins 301 equiangularly extending downward from the bottom edge thereof and a plurality of grooves 300 equiangularly made on the topmost edge thereof in radial direction, wherein said grooves 300 are respectively staggered from said pins 301. By fastening the pins 301 in the posts 310, the top ring 30 is supported above the ring-shaped, tapered top edge 32 of the base container 31 with a gap defined between the top ring 30 and the base container 31. If a burning cigarette 4 is placed in either groove 300 on the top ring 30, the cigarette 4 may fall from the top ring 30 to the ring-shaped, tapered top edge 32 of the base container 31 and then is guided by the slopping surface of the ring-shaped, tapered top edge 32 to the chamber inside the base container 31 (see FIG. 6).

By detaching the pins 301 from the posts 310, the top ring 30 can be conveniently removed from the base container 31 for removing the tobacco ashes 40 from the base container 31.

I claim:

1. An ashtray comprising a base container defining therein a chamber for collecting tobacco ashes, and a top ring mounted on said base container at the top for placing a burning cigarette; wherein:

said base container has a ring-shaped, tapered top edge and three ornamental posts vertically equiangularly rising from said ring-shaped, tapered top edge, each of said ornamental posts having a hole on the topmost edge thereof;

said top ring having an outer diameter smaller than the outer diameter of said ring-shaped, tapered top edge of said base container and comprising three pins equiangularly extending downward from the bottom edge thereof and respectively fastened in said hole on the topmost edge of each of said ornamental posts and a plurality of grooves equiangularly made on the topmost edge thereof in radial directions for placing a burning cigarette, said grooves being respectively staggered from said pins; and wherein:

a cigarette butt dropping from any of said grooves on said top ring will be guided by said ring-shaped, tapered top edge of said base container to fall to said chamber.

* * * * *